US005261434A

United States Patent [19]

Fodero

[11] Patent Number: 5,261,434

[45] Date of Patent: Nov. 16, 1993

[54] COMBINATION UMBRELLA AND GOLF BALL RETRIEVER

[75] Inventor: Randolph S. Fodero, Shrewsbury, N.J.

[73] Assignee: Tech Sport, Inc., Little Silver, N.J.

[21] Appl. No.: 18,319

[22] Filed: Feb. 16, 1993

[51] Int. Cl.[5] ..... A45B 3/00

[52] U.S. Cl. ..... 135/16; 135/33.6; 403/326; 403/329; 403/342

[58] Field of Search ..... 135/15.1, 16, 17, 18, 135/19, 19.5, 25.1, 33.6; 403/326, 330, 329, 342, 343

[56] References Cited

U.S. PATENT DOCUMENTS

| | | | |
|---|---|---|---|
| 2,609,638 | 9/1952 | Lindenmeyer | 403/343 X |
| 2,982,586 | 5/1961 | Gliebe | 403/326 X |
| 4,642,837 | 2/1987 | Nichols et al. | 403/342 X |
| 4,733,681 | 3/1988 | Lee | 135/16 |
| 4,790,338 | 12/1988 | Strobl | 135/16 |

*Primary Examiner*—Peter M. Cuomo

*Assistant Examiner*—Lan M. Mai

*Attorney, Agent, or Firm*—R. Gale Rhodes, Jr.

[57] ABSTRACT

Combination umbrella and golf ball retriever comprised of a plurality of telescopically interconnected tubular members which are nested in the umbrella shaft and extended therefrom to form an elongated handle for the golf ball retriever. An annular locking collar surrounds the umbrella shaft and threadedly engages an annular support collar to mount the support collar fixedly to the upper end of the umbrella shaft. The inner ends of a plurality of canopy supporting ribs are mounted pivotally to the support collar. An annular sliding member surrounds the shaft and slides up and down the shaft to close and open the umbrella, the inner ends of a plurality of braces are mounted pivotally to the sliding collars and the outer ends of the braces are mounted pivotally intermediate the ends of the canopy supporting ribs. A golf ball retriever mounting tip is secured to the end of the golf ball retriever and a golf ball retriever is mounted removably to the tip.

5 Claims, 2 Drawing Sheets

COMBINATION UMBRELLA AND GOLF BALL RETRIEVER

BACKGROUND OF THE INVENTION

This invention relates to a new and improved combination umbrella and golf ball retriever.

Combination umbrella and golf ball retriever is known to the prior art and is disclosed, for example, in U.S. Pat. No. 4,733,681. The umbrella of such typical prior art combination typically includes a tubular umbrella shaft provided with a handle at the lower end and with an umbrella canopy at the upper end supported underneath by a plurality of radially disposed ribs having their outer ends connected to the outer edge of the canopy. The inner end of the ribs are mounted pivotally to a stationary member fixed at the upper end of the umbrella shaft and the central portion of the canopy is also typically mounted to this stationary member. The umbrella further typically includes a plurality of braces having their upper ends mounted pivotally to the ribs intermediate the ends thereof and having their lower ends mounted pivotally to a sliding member surrounding the umbrella shaft for being moved upwardly along the shaft into a locked position to open the umbrella canopy and for being unlocked from the shaft and moved downwardly along the shaft to close the umbrella canopy. Typically the shaft of the golf ball retriever is comprised of a plurality of telescopically interconnected tubular members nested within the umbrella shaft and which tubular members are telescopically extendable outwardly of the umbrella shaft to provide a golf ball retriever shaft having a circular or cup-shaped member for retrieving golf balls residing in water, in bushes or at a distance from the golfer which prevents the golfer or his caddie from retrieving the golf ball by extending his hand and arm. In the combination umbrella and golf ball retriever disclosed in U.S. Pat. No. 4,790,338 the golf ball retriever shaft extends telescopically inwardly and outwardly of the handle end of the umbrella shaft.

Typically the structure of the prior art combination umbrella and golf ball retriever is rather complex so much so that the cost of manufacture, and hence the sale price, are undesirably high.

Accordingly, there exists a need in the art for a new and improved combination umbrella and golf ball retriever which is relatively uncomplicated in design so as to provide relatively inexpensive manufacture with an attendant reduced sales price.

OBJECT OF THE INVENTION

The object of the present invention is to satisfy the foregoing need in the art.

Combination umbrella and golf ball retriever satisfying such need and embodying the present invention includes an annular support collar and an annular locking collar comprising the stationary member to which the inner ends of the canopy support ribs are pivotally connected. The annular support collar includes a pair of resiliently mounted tabs for being forced into a pair of opposed holes formed in the umbrella shaft upon the annular locking collar being threaded into compressive engagement with the support collar to mount the support collar fixedly to the umbrella shaft. The sliding member to which the lower ends of the braces are pivotally connected includes an annular collar slidably surrounding the umbrella shaft and a spring bias locking clip mounted pivotally on the collar. Upon the collar being moved upwardly of the umbrella shaft the locking clip includes a nose portion for being pivoted into a hole or indentation formed in the shaft to temporarily lock the sliding collar to the umbrella shaft to thereby cause the braces to extend the canopy support ribs and open the canopy attached thereto. Upon the locking clip being manually pivoted away from the umbrella shaft the sliding collar is unlocked from the shaft and the sliding collar may be moved downwardly along the shaft to close the umbrella canopy.

The golf ball retriever is formed of a plurality of telescopically interconnected tubular members of successively smaller diameters fitted one inside another with the smallest of the tubular members having a golf ball retriever mounting tip mounted fixedly at its outer end. The golf ball retriever mounting tip includes a cylindrical portion provided with a flat which is in turn provided with a transverse groove. The golf ball retriever includes a generally annular golf ball retrieving ring and extending from the ring is a tubular portion provided with an internal flat and with a flexible tab supporting member provided with a tab extending inwardly into the tubular portion. Upon the flats being aligned and the tubular portion being forced over the cylindrical portion of the golf ball retriever mounting tip, the resilient tab supporting member is flexed outwardly until the tab is aligned with the groove formed on the cylindrical member whereupon the tab snaps into the groove to mount the golf ball retriever temporarily to the golf ball retriever mounting tip.

DESCRIPTION OF THE PREFERRED EMBODIMENT

Figure 1:
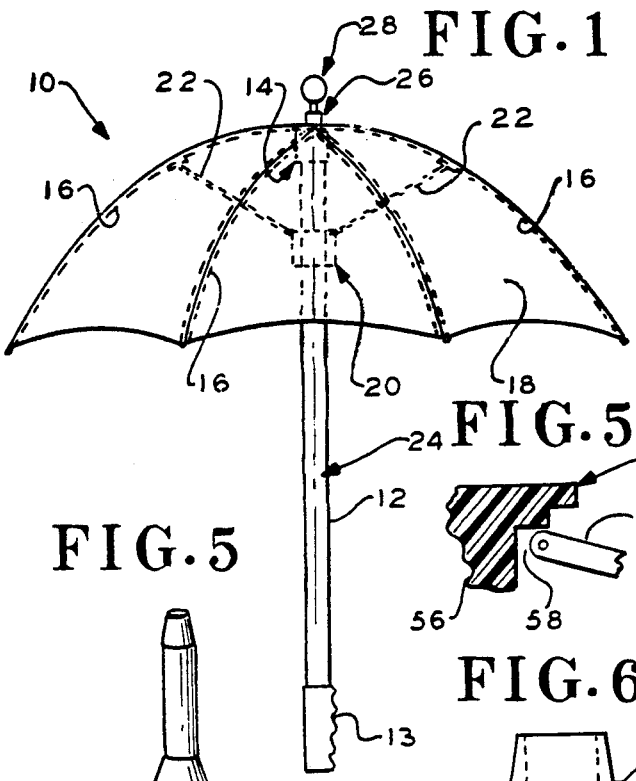
FIG. 1 is a diagrammatical general illustration of the combination umbrella and golf ball retriever of the present invention with the umbrella canopy being shown in the open position.
Figure 2:
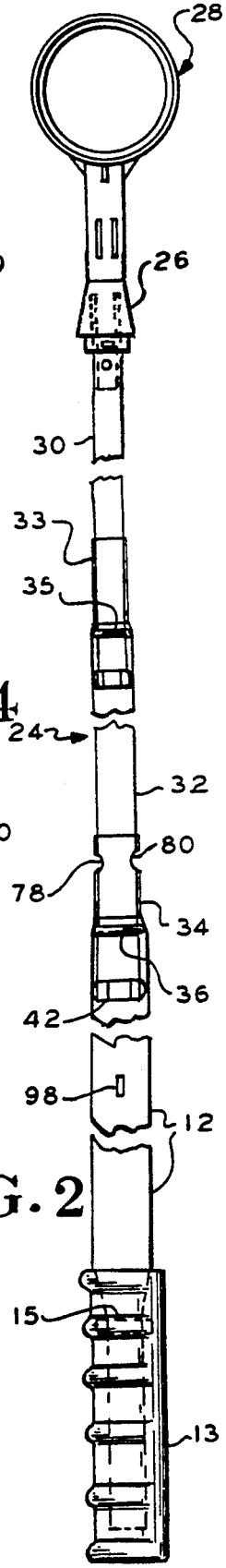
FIG. 2 is a diagrammatical illustration of the golf ball retriever shaft of the present invention shown extended telescopically out of the umbrella shaft.

Referring to FIG. 1, an embodiment of a combination umbrella and golf ball retriever of the present invention is illustrated diagrammatically and indicated by general numerical designation 10. The combination includes a tubular golf umbrella shaft 12 which has a handle 13 mounted at its lower end and a stationary member indicated by general numerical designation 14 mounted at its upper end. A plurality of ribs or ribbed framing members 16 have their radially inner ends mounted pivotally to a stationary member 14, in the manner described in detail below, and the ribs 16 support the umbrella canopy 18 and have their radially outwardly extending ends suitably connected to the edges of the canopy in the manner known to the art. The combination further includes a sliding member or sliding collar indicated by general numerical designation 20 which surrounds the umbrella shaft 12 for reciprocal sliding movement upwardly and downwardly thereof and the inner ends of a plurality of braces or frame support members 22 have their inner ends mounted pivotally to the sliding collar 20 and have their outer ends mounted pivotally to the ribs 16 intermediate the ends thereof in the manner known to the art. The golf ball retriever shaft shown in detail in FIG. 2 is illustrated diagrammatically in FIG. 1 by the vertical dashed line indicated by general numerical designation 24. It will be understood generally that the golf ball retriever shaft 24 is comprised of a plurality of telescopically interconnected tubular members which may be retracted and nested in the tubular umbrella shaft 12 in the manner known to the art and as illustrated and described in detail in the two above-noted U. S. patents. Mounted to the upper end of the tubular member of the smallest diameter comprising the golf ball retriever shaft 24 is a golf ball retriever mounting tip or member indicated by general numerical designation 26 and to which a golf ball retriever indicated by general numerical designation 28 is mounted in a manner described in detail below.

Figure 3:
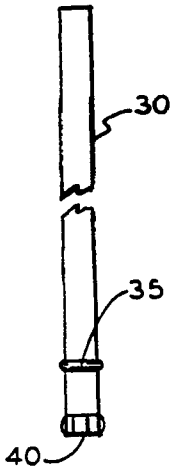
FIG. 3 is a separate view of one of the tubular members comprising the golf ball retriever shaft.
Figure 4:
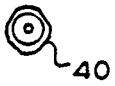
FIG. 4 is a bottom end view of the tubular member shown in FIG. 3.

The golf ball retriever shaft 24 is shown in detail in FIG. 2 and may be comprised of the plurality of telescopically interconnected tubular members 30 and 32 of inwardly successive smaller diameters. From FIG. 2 it will be noted that the tubular member 32 is provided with an upper portion 33 of reduced diameter and that the tubular umbrella shaft 12 is provided with an upper portion of reduced diameter 34. A stop ring 35 is provided adjacent the lower end of the tubular member 30 for engagement with the reduced diameter portion 33 of the tubular member 32 to stop the outward extension of the tubular member 30 with respect to the tubular member 32; the stop ring 35 may be better seen in FIG. 3, and it will be understood that the stop ring 35 may be made by outwardly flaring a portion of the tubular member 30. Similarly, the tubular member 32 is provided near its lower end with a stop ring 36 for engaging the reduced upper end portion 34 of the tubular umbrella shaft 12 to stop the outward extension of the tubular member 32 with respect to the umbrella shaft 12. The inner or bottom end of the tubular member 30, FIGS. 2 and 3, may be provided with a spacer and aligning member 40, which may be made for example of a suitable slick plastic of the type known to the art and which spacer and aligning member 40 may be suitably secured to the end of the tubular member 30 such as by a suitable adhesive; the spacer and aligning member 40 may include pairs of opposed outwardly extending projections as illustrated in FIG. 4. Similarly, the tubular member 32 may be provided at its bottom end with a spacer and aligning member 42 of the same construction as the spacer and aligning member 40 described above. The spacer and aligning members 40 and 42 maintain the lower portion of the tubular members 30 and 32 respectively spaced from and axially aligned with the inner walls of the tubular member 32 and the umbrella shaft 12 to facilitate relative sliding movement therebetween. The lower portion of the umbrella shaft 12 may be provided with a suitable mounting ring 15 for facilitating fixedly mounting of the lower end of the shaft 12 to the handle 13 such as by a suitable adhesive.

Figure 5A:
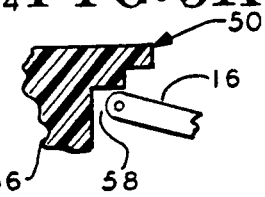
FIG. 5A is a partial cross-sectional view illustrating the manner in which the ribs are mounted pivotally to the lower annular portion of the sliding collar.
Figure 5:
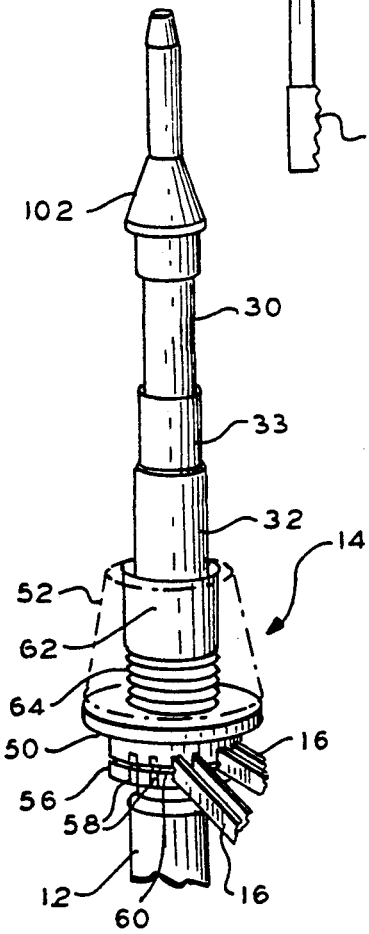
FIG. 5 is a partial perspective view showing in particular the support collar of the present invention.
Figure 6:
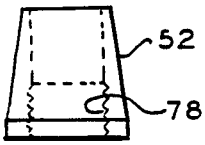
FIG. 6 is a side elevational view of the locking collar of the present invention.
Figure 7:
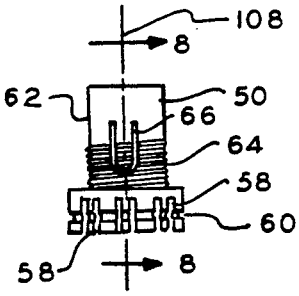
FIG. 7 is a side view of the support collar of the present invention showing in detail one of the resilient tab supporting members.
Figure 8:
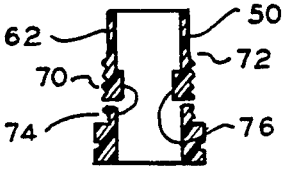
FIG. 8 is a vertical cross-sectional view taken along the line 8—8 in FIG. 7 in the direction of the arrows.

The structure of the stationary member 14 of FIG. 1 is shown in detail in FIGS. 5–8, and it will be understood that such stationary includes a generally annular support collar 50 shown in solid outline in FIGS. 5, 7 and 8 and a generally annular locking collar 52 shown in dashed outline in FIG. 5 and in solid outline in FIG. 6. The lower portion 56 of the support collar 50, FIGS. 5 and 7, is provided with a plurality of inwardly extending slots 58 for receiving the inner ends of the radially disposed ribs or rib framing members 16 which are mounted pivotally to the annular lower portion 56 of the support collar by a retaining ring (not shown) which resides in the groove 60, FIG. 7, in the same manner that the braces 26 are mounted pivotally to the locking collar 28 by the retaining ring 36 as illustrated in FIGS. 4 and 5 of U.S. Pat. No. 4,790,338 and as described therein. The support collar 50 includes an upper tubular portion 62 provided with a plurality of external threads 64 which threads, as may be understood from FIG. 7, are a plurality of interrupted external threads interrupted by the U-shaped slot 66 shown in FIG. 7 and it will be understood that another U-shaped slot, not shown, is provided in the tubular portion 62 diametrically opposite the U-shaped slot 66. The support collar 50 may be made of a suitable resilient plastic material and it will be understood that such U-shaped slots provide the tubular portion 62 with a pair of diametrically opposed and integrally formed resilient tab supporting members 70 and 72, shown in FIG. 8, and which tab supporting members support a pair of diametrically opposed tabs 74 and 76 extending inwardly into the interior of the tubular portion 62. The annular locking collar 52, FIG. 6, is provided with a plurality of internal threads 78 and upon the annular support collar 50 being placed over the upper end of the umbrella shaft 12, FIG. 2, with the tabs 74 and 76 being placed opposite a pair of diametrically opposed holes 78 and 80 formed in the upper end of the umbrella shaft 12 as shown in FIG. 2, and upon the annular locking collar 52 being rotated with respect to the support collar 50 to place the internal threads 78 and external threads 64 into threaded engagement, the locking collar 52 will compress the tubular portion 62 of support collar 70 to flex the resilient tab supporting members radially inwardly and to force the tabs 74 and 76 into the holes 78 and 80 to mount the support collar 50 stationarily or fixedly to the upper end of the umbrella shaft 12.

Figure 9:
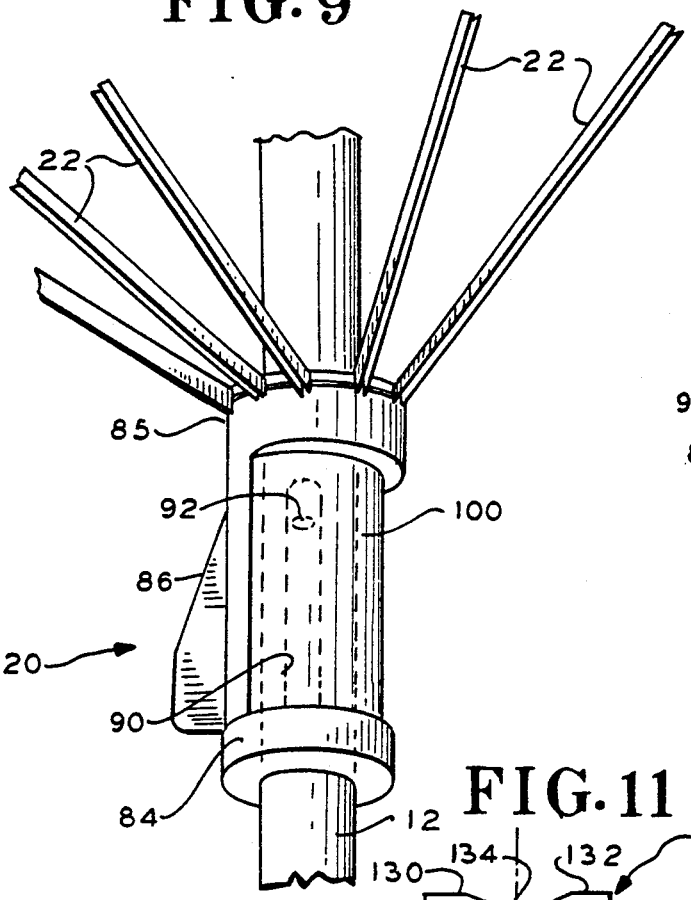
FIG. 9 is a perspective view particularly of the sliding collar of the present invention.
Figure 10:
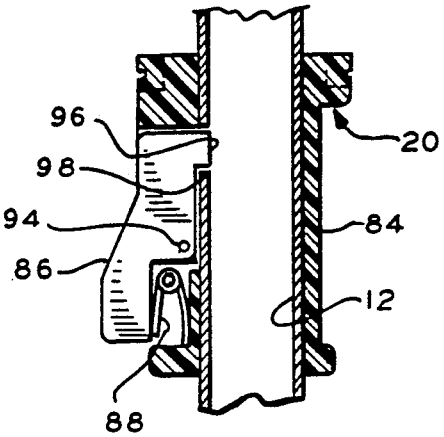
FIG. 10 is a partial vertical cross-sectional view of the sliding collar of the present invention illustrating the pivotal inward biasing of the locking clip of the present invention.

The structure of the sliding collar 20 of FIG. 1 is shown in detail in FIGS. 9 and 10. Sliding collar 20 includes a generally annular slidable collar 84 slidably surrounding the umbrella shaft 12, a locking clip 86 and a spring 88, FIG. 10. It will be understood that the inner ends of the braces or frame support members 22 are mounted pivotally to the upper annular portion 85 of the sliding collar 84 in the same manner that the inner ends of the ribs or rib frame members are mounted to the stationary collar 50 in FIG. 5. The sliding collar 84 is provided with an axial slot 90 shown in dashed outline in FIG. 9. The slot extends partially radially inwardly of the sliding collar 84 and is provided with a hole 92, shown in dashed outline in FIG. 9, extending from the slot 90 into the interior of the slidable collar 84. The retaining clip 86 is mounted pivotally in the slot 90 by the pin 94 shown in FIG. 10 and the spring clip 86 is provided with a radially inwardly extending nose portion 96 as shown in FIG. 10. The spring 88, FIG. 10, engages the retaining clip 86 to bias the clip for inward pivotal movement and to urge the nose portion 96 inwardly through the hole 92 to the interior of the slidable collar 84 as may be also understood from FIG. 10. Upon the slidable collar 84 sliding over the umbrella shaft 12 to place the nose portion 96 of the spring clip 86 opposite a hole or indentation 98 formed in the umbrella shaft 12, as shown in FIGS. 2 and 10, the nose portion 96 enters the hole or indentation 98 and mounts the sliding collar 84 temporarily stationary with respect to the umbrella shaft 12 and to cause the braces or frame support members 22 to extend the ribs or rib frame members 16, FIG. 1, radially outwardly thereby to expand the umbrella canopy 18, FIG. 1, and open the umbrella 10 of FIG. 1. Upon the spring clip 86 being manually pivoted outwardly to remove the nose portion 86 from the hole or indentation 98 and upon the sliding collar being manually moved downwardly along the umbrella shaft 12 toward the umbrella handle 14, FIG. 1, the braces or frame support members 22 move radially downwardly to collapse the umbrella canopy 18 and close the umbrella 10. As is best shown in FIG. 9, sliding collar 84 may be provided with an indented or inwardly extending portion 100 to facilitate grasping of the sliding collar 84 by the hands of a golfer or caddie opening and closing the umbrella 10.

Figure 11:
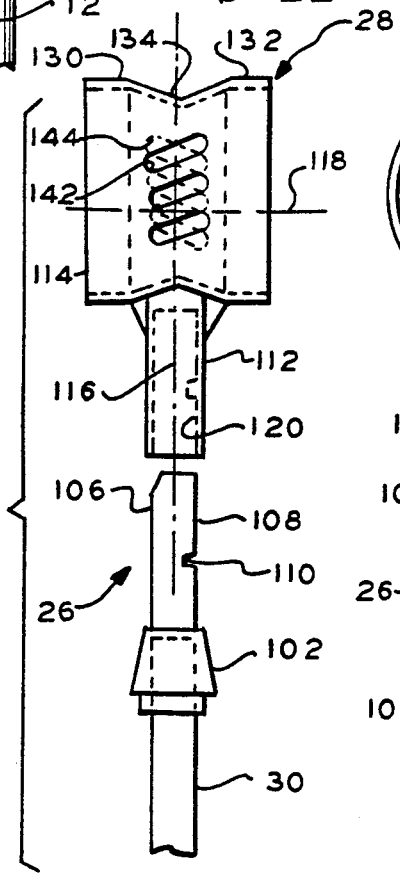
FIG. 11 is an exploded vertical elevational view showing the golf ball retriever mounting member or tip and a side view of the golf ball retriever of the present invention.
Figure 12:
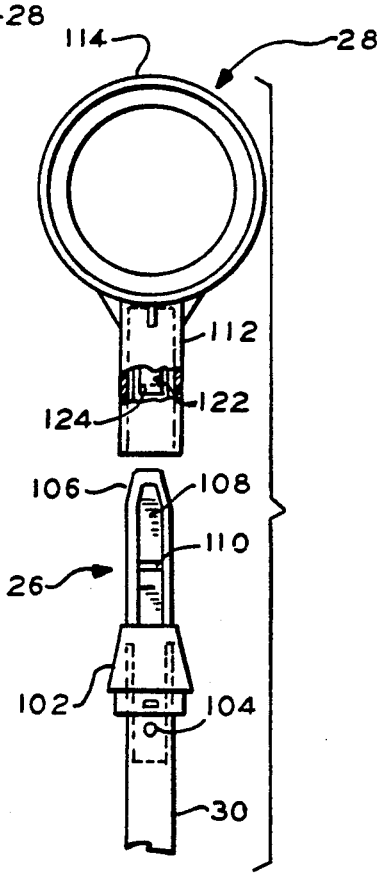
FIG. 12 is a right side view of the structure shown in FIG. 11.
Figure 13:
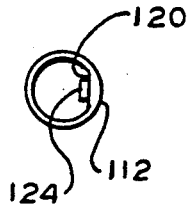
FIG. 13 is a bottom end view of the tubular portion of the golf ball retriever shown in FIGS. 11 and 12.

The golf ball retriever mounting member or tip 26 of FIG. 1 is shown in detail in FIGS. 11 and 12 and includes a lower conical portion 102 which may be mounted fixedly to the upper end of the upper tubular member 30 by a suitable adhesive and by staking the upper portion of the tubular member 30 to the portion 102 as indicated diagrammatically by numerical designation 104 in FIG. 12. The golf ball retriever mounting member further includes a generally solid cylindrical upper portion 106 provided with an axially extending external flat 108 provided with an inwardly extending transverse groove 110. As is also shown in FIGS. 11 and 12, the golf ball retriever 28 includes an integrally formed tubular portion 112 and a generally annular ring portion 114 with the axis 116 of the tubular portion 112 being perpendicular to the axis 118 of the generally annular ring portion 114 as shown in FIG. 11. The tubular portion 112 of the golf ball retriever 128 is provided interiorly with an axially extending internal flat portion 120 and an integrally formed resilient tab supporting member 122, FIG. 12, formed in the tubular portion 112 coincident with the flat portion 120. The resilient tab supporting member 122 is provided with a transverse tab 124 extending inwardly into the interior of the tubular portion 112, note FIG. 13. The solid cylindrical portion 108 of the golf ball retriever mounting member 26 and the tubular portion 112 of the golf ball retriever 28 are dimensioned for sliding interference engagement and, upon the flat portions 108 and 120 being aligned and the tubular portion 112 being forced downwardly over the solid cylindrical portion 106 the resilient tab supporting member 122 is flexed outwardly until the tab 124 is aligned with the groove 110 whereupon the tab 124 snaps into the groove 110 to mount the golf ball retriever 28 to the golf ball retriever mounting tip 26 temporarily stationarily removably therefrom.

Referring again to the golf ball retriever 28 shown in FIGS. 11 and 12, particularly FIG. 11, it will be understood that the generally annular golf ball retriever includes a pair of generally outwardly flared conical portions 130 and 132 and which conical portions include outer portions and a common inner portion 134 with the inner diameters of the conical outer portions 130 and 132 being larger than the inner diameter of the golf ball and with the diameter of the common inner portion 134 being smaller than the diameter of a golf ball. The golf ball retriever 128, as shown in FIG. 11, may be provided with a pair, or pairs as shown, of opposed holes, e.g. 142 and 144, for facilitating the flow of water therethrough to facilitate the retrieving of golf balls from water.

It will be understood that the annular support collar 50 and annular locking collar 52 of FIGS. 5 and 6, the sliding collar 84 of FIG. 9, and the golf ball retriever mounting member or tip 26 and golf ball retriever 28 of FIGS. 11 and 12 may be made of a suitable, at least slightly resilient, plastic and may be made, for example, such as by injecting molding.

It will be understood by those skilled in the art that many modifications and variations may be made in the present invention without departing from the spirit and the scope thereof.

What is claimed is:

1. In a combination umbrella and golf ball retriever, said umbrella including a tubular umbrella shaft having a handle mounted at one end thereof and stationary means surrounding said shaft and mounted fixedly at the other end thereof to which is pivotally mounted the inner ends of a plurality of ribbed frame members supporting the umbrella canopy, a sliding member surrounding said shaft intermediate said handle and said stationary means and for reciprocal axial sliding movement with respect to said shaft and to which sliding member one of the ends of a plurality of frame support members are mounted with the other ends of said plurality of frame support members mounted pivotally to said plurality of ribbed frame members intermediate the ends thereof, said golf ball retriever including a plurality of telescopically interconnected tubular members of inwardly successive smaller diameter nested in said umbrella shaft and extendable axially outwardly thereof to provide a golf ball retriever shaft, the tubular member of the smallest diameter provided with a golf ball retriever mounting member at the outer end thereof, and a golf ball retriever mountable on said golf ball retriever mounting member, wherein the improvement comprises:

said other end of said umbrella shaft provided with a pair of diametrically opposed holes, wherein said stationary means include a generally annular support collar and a generally annular locking collar, said support collar including a tubular upper portion provided with a pair of diametrically opposed and integrally formed resilient tab supporting members supporting a pair of diametrically opposed tabs extending inwardly into the interior of said tubular portion, said tubular portion provided with interrupted external threads extending across the external portions of said tab support members on which said inwardly extending tabs are provided, said annular locking collar provided with a plurality of internal threads and upon said locking collar being placed over said tubular portion of said support collar and rotated with respect thereto, said internal threads being placed into threaded engagement with said external threads to compress at least said tab supporting members radially inwardly to cause said tabs to enter said holes and mount said support collar stationarily to said other end of said umbrella shaft; and said support collar including an annular lower portion to which said inner ends of said plurality of ribbed frame members are pivotally mounted.

2. The combination umbrella and golf ball retriever of claim 1 wherein said umbrella shaft includes a third hole or indentation holeintermediate handle and said pair of diametrically opposed holes, and wherein said sliding member includes a generally annular slidable collar, a locking clip and a spring, said sliding collar provided with an inwardly extending axial slot provided with a fourth hole extending into the interior said sliding collar, said retaining clip mounted pivotally in said slot and provided with an inwardly extending nose portion, said spring mounted in said slot and engaging said retaining clip to bias said clip for inward pivotal movement and to urge said nose portion inwardly through said fourth hole to the interior of said slidable collar, and upon said slidable collar sliding over said umbrella shaft to place said nose portion of said retaining ring opposite said third hole, said nose portion entering said third hole through said fourth hole to mount said sliding collar temporarily stationary with respect to said umbrella shaft and to cause said frame support members to extend said ribbed frame members radially outwardly thereby to expand said umbrella canopy and open said umbrella, and upon said clip being manually pivoted outwardly to remove said nose portion from said third hole and upon said sliding member being manually moved downwardly of said shaft toward said handle said rib frame members moving radially inwardly to collapse said canopy and close said umbrella.

3. The combination umbrella and golf ball retriever according to claim 1 or 2 wherein said golf ball retriever mounting member includes a generally solid cylindrical member having two ends, one of said ends mounted fixedly to said outer end of said tubular member of said smallest diameter and having the other end provided with an axially extending external flat provided with an inwardly extending transverse groove, and wherein said golf ball retriever includes an integrally formed tubular portion and a generally annular ring portion for retrieving golf balls, the axis of said tubular portion and the axis of said ring portion being disposed perpendicular with respect to each other, said tubular portion provided interiorly with an axially extending internal flat portion and an integrally formed resilient tab supporting member formed in said tubular portion coincident with said flat portion, said resilient tab supporting member provided with a transverse tab extending inwardly into the interior of said tubular portion, said solid cylindrical member and said tubular member dimensioned for sliding interference engagement upon said flat portions being aligned and upon said tubular portion of said golf ball retriever being forced over said solid cylindrical member of said golf ball retriever mounting member said resilient tab supporting member being flexed outwardly until said transverse tab is aligned with said transverse groove whereupon said transverse tab snaps into said transverse groove to temporarily stationarily mount said golf ball retriever to said golf ball retriever mounting member.

4. The combination umbrella and golf ball retriever according to claim 3 wherein said generally annular ring portion of said golf ball retriever comprises a pair of generally outwardly flared generally conical portions, said conical portions including outer portions and a common inner portion, the inner diameters of said outer portions being larger than the inner diameter of a golf ball and the diameter of said common inner portion being smaller than the diameter of a golf ball.

5. The combination umbrella and golf ball retriever according to claim 4 wherein said generally annular golf ball retaining ring is provided with a pair of opposed holes for facilitating the flow of water therethrough to facilitate the retrieving of golf balls from water.

* * * * *